US011020643B2

(12) United States Patent
Garland et al.

(10) Patent No.: US 11,020,643 B2
(45) Date of Patent: Jun. 1, 2021

(54) BASEBALL BASE

(71) Applicant: Major League Baseball Properties, Inc., New York, NY (US)

(72) Inventors: Tylor Garland, Los Angeles, CA (US); Stephen Bradford, Los Angeles, CA (US); Michael Latham, Los Angeles, CA (US); Andrew Castro, Los Angeles, CA (US); Robert Reich, Los Angeles, CA (US); Cezanne Farris-Gilbert, Los Angeles, CA (US); Will Song, Los Angeles, CA (US)

(73) Assignee: MAJOR LEAGUE BASEBALL PROPERTIES, INC., New York, NY (US)

( * ) Notice: Subject to any disclaimer, the term of this patent is extended or adjusted under 35 U.S.C. 154(b) by 0 days.

(21) Appl. No.: 16/584,582

(22) Filed: Sep. 26, 2019

(65) Prior Publication Data

US 2020/0101361 A1 Apr. 2, 2020

Related U.S. Application Data

(60) Provisional application No. 62/737,516, filed on Sep. 27, 2018.

(51) Int. Cl.

| | |
|---|---|
| ***A63B 71/00*** | (2006.01) |
| ***A63B 69/00*** | (2006.01) |
| ***A63B 71/02*** | (2006.01) |

(52) U.S. Cl.

CPC ..... *A63B 69/0013* (2013.01); *A63B 71/023* (2013.01); *A63B 2071/024* (2013.01)

(58) Field of Classification Search

CPC ... A63C 19/04; A63B 69/0013; A63B 71/023; A63B 2071/024; A63B 69/00

USPC ..... 473/497, 499–501, 452, 422

See application file for complete search history.

(56) References Cited

U.S. PATENT DOCUMENTS

| | | | | | |
|---|---|---|---|---|---|
| 1,244,044 | A | * | 10/1917 | Falconer, Sr. | A63B 69/0013 473/499 |
| 2,624,580 | A | | 1/1953 | Corbett | |
| 2,695,784 | A | | 11/1954 | Orsatti et al. | |
| 3,126,203 | A | * | 3/1964 | Bourret | A63C 19/04 473/499 |
| 3,466,039 | A | * | 9/1969 | Golomb | A63C 19/04 473/499 |
| 3,572,705 | A | * | 3/1971 | Wyble | A63B 69/0013 473/499 |
| 3,836,146 | A | * | 9/1974 | Golomb | A63C 19/04 473/499 |
| 3,971,558 | A | * | 7/1976 | Gardetto | A63B 69/0013 473/499 |

(Continued)

*Primary Examiner* — Mitra Aryanpour

(74) *Attorney, Agent, or Firm* — Leason Ellis LLP

(57) ABSTRACT

A base for use in athletic base running games includes a ground anchor assembly that includes: a post for insertion into a ground playing surface, and a base portion disposed along a top of the post. The base also includes a reinforcement plate, such as an X-plate, coupled to a top surface of the base portion. The X-plate has four arms arranged in an X orientation for providing increased stiffness in the four corners of the base. The arms extend radially outward from the base portion. A cover is disposed over and is coupled to the X-plate and can be formed as part of an overmold process.

21 Claims, 12 Drawing Sheets

(56) References Cited

U.S. PATENT DOCUMENTS

| | | | | | |
|---|---|---|---|---|---|
| 4,976,430 | A | * | 12/1990 | Brandon | A63B 69/0013 473/501 |
| 4,979,470 | A | | 12/1990 | Hall | |
| 5,000,447 | A | * | 3/1991 | Bartoli | A63B 69/0013 473/499 |
| 5,080,356 | A | * | 1/1992 | Green | A63B 69/0013 473/501 |
| 5,251,894 | A | * | 10/1993 | Boatman | A63B 69/0013 473/499 |
| 5,415,395 | A | | 5/1995 | Bartoli | |
| 8,070,631 | B2 | | 12/2011 | Nimmons | |

* cited by examiner

SECTION A-A
SCALE 1 : 3

BASEBALL BASE

CROSS REFERENCE TO RELATED APPLICATION

The present application claims the benefit of and priority to U.S. patent application Ser. No. 62/737,516, filed Sep. 27, 2018, which is hereby incorporated by reference in its entirety.

TECHNICAL FIELD

The present invention relates to sports equipment and more particularly to an improved baseball base and in particular to the mounting and anchoring of a base used for baseball, softball or other ball games.

BACKGROUND

As is well known, baseball is a popular game and in particular is a bat-and-ball game played between two opposing teams who take turns batting and fielding. The players on the team at bat attempt to score runs by circling or completing a tour of the four bases set at the corners of the square-shaped baseball diamond. A player bats at home plate and must proceed counterclockwise to first base, second base, third base, and back home to score a run. The team in the field attempts to prevent runs from scoring by recording outs.

Baseball bases thus are one of the integral parts of the baseball field. The construction of these bases in professional play is governed by the Major League Baseball rulebook. Other leagues can have other guidelines and rules. However, in general, the rules govern the color (white); size (e.g., 15 inches by 15 inches); the height; and the material used to form the base and attach it to the ground. Since players rounding the bases make contact with the bases, the construction of the base is very important. Typically, a base is a few inches tall around the perimeter and domes slightly to a maximum height. They are heavy and do not puncture under the weight of metal spikes. The middle of the underside contains a protruding nub that interlocks with a permanent hole in the field to ensure that the base remains in place during play and when forces are applied thereto by the players.

During the rounding of a base or during a steal attempt, there are times that a player will need to "slide" into the base. In baseball, a slide is the action of a player, acting as a baserunner, who drops his body to the ground once he is very close to the base he is approaching and slides along the ground to reach the base. A baserunner may slide into a base in a number of different ways, such as feet first or headfirst, and for a number of different reasons. It is very important to avoid injury to the players when they are "sliding into the base" and therefore, it is desirable for the baseball base to be constructed in view of this objective as well as other traditional objectives.

The present invention is directed to and provides a solution to the above objective.

SUMMARY

In one implementation, a base for use in athletic base running games includes a ground anchor assembly that includes: a post for insertion into a ground playing surface, and a base portion disposed along a top of the post. The base also includes a reinforcement plate, such as an X-plate, coupled to a top surface of the base portion. The X-plate has four arms arranged in an X orientation. The arms extend radially outward from the base portion. A cover is disposed over and is coupled to the X-plate and can be formed as part of an overmold process.

The bases disclosed herein are constructed in view of player's movements along the field and in particular, the bases are constructed such that they have localized stiffness, while having reduced stiffness in other areas of the base. More particularly, along the sides of the base that represent the areas of the base that are typically contacted by the player, as when sliding into the base and/or rounding the bases, the base is constructed to have reduced stiffness. In contrast, in its four corners, the base has increased stiffness due to the presence of the arms in the four corners.

BRIEF DESCRIPTION OF THE DRAWING FIGURES

DETAILED DESCRIPTION OF CERTAIN EMBODIMENTS

Figure 1:
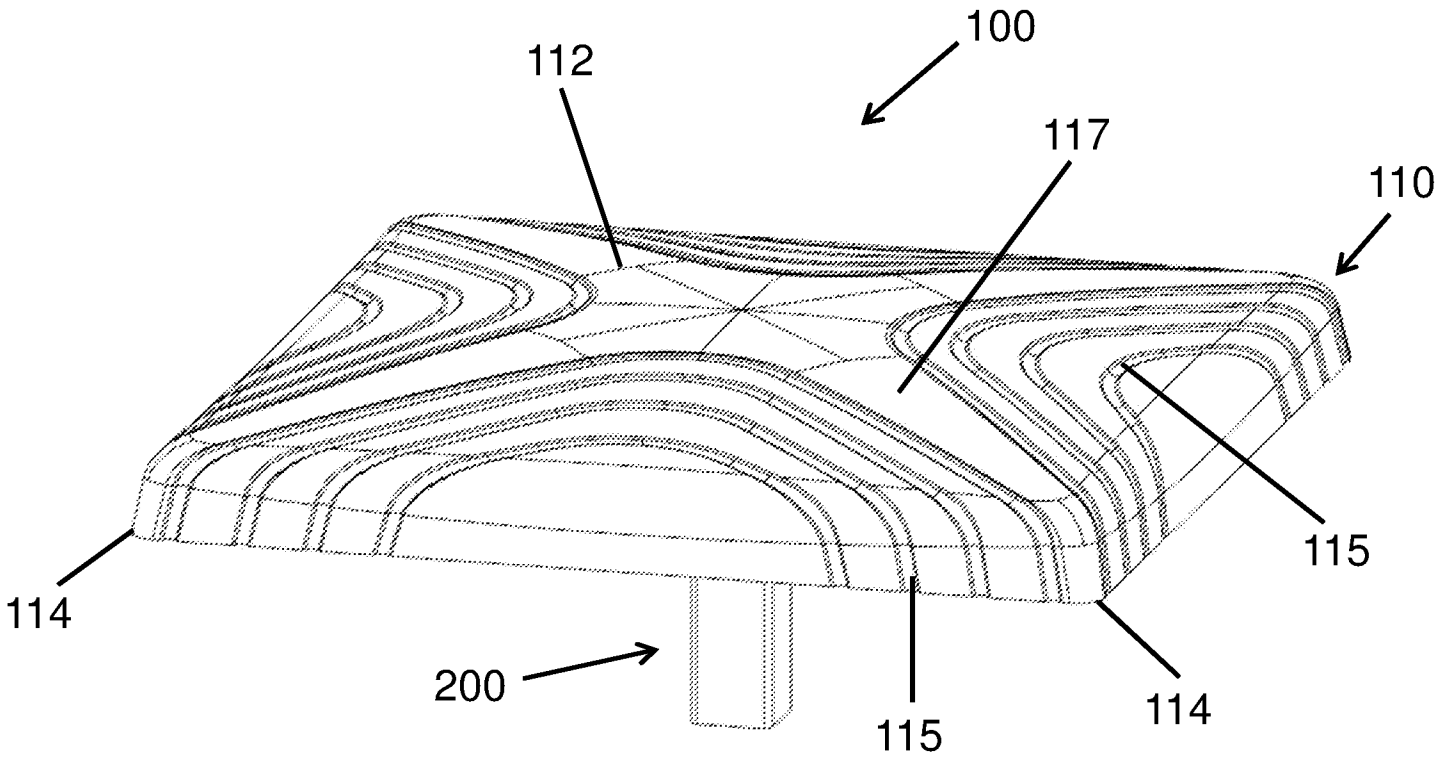
FIG. 1 is top and side perspective view of a baseball base according to a first implementation.

FIG. 1 illustrates a baseball base 100 according to one exemplary implementation. The baseball base 100 generally includes a cover 110 and a ground anchor assembly that is generally shown at 200. As described herein, the cover 100 is the topmost part of the baseball base 100 that is contacted by the player and sits about the ground playing surface. The ground anchor 200 is the part that is anchored into the ground playing surface.

The cover 110 is coupled to the ground anchor 200 using any number of techniques, including but not limited to an overmold process in which the material forming the cover 100 is overmolded over the ground anchor assembly 200. As is known, overmolding is a process in which a single part is created using two or more different materials in combination. Typically, the first material, sometimes referred to as the substrate, is partially or fully covered by subsequent materials (overmold materials) during the manufacturing process. Alternative methods can include a mechanical interface/fit.

The cover 110 is formed of any number of suitable materials including suitable materials that can be overmolded over the ground anchor 200. For example, suitable materials include suitable polymers and in one implementation, the cover 110 is formed of urethane. As is known, there are different types of urethanes including urethane coverings and urethane foams to name a few. The cover 110 can include an integral skin surface and a cushion core that provides consistent grip and cushioned support.

The cover 110 is square shaped with a top surface 112 and four corners 114. The dimensions, including the width, length, and height, are governed by associated league rules when the cover 110 is intended for use in an official league game. In FIG. 1 illustrates the top surface 112 containing surface features in the form of surface channels 115 that are integrally formed in and along the top surface 102. In the illustrated embodiment, each channel 115 is formed along one side of the cover 110 in that the two opposing open ends of the channel 115 are located along one side of the cover 110. The channeling formed in the top surface 112 can be symmetric in that each side of the cover 110 can have the same channel profile. As shown, the channels 115 extend across the top surface and wrap downwardly along a side wall of the cover 110. This construction permits any water to be channeled from the top surface to the ground playing surface.

It will be seen that the various surface channels 115 define an X-shaped region 117 that is not adorned with channeling. The X-shaped region 117 has defined arms 119 that extend from a center of the top surface 112 to one of the corners of the cover 110. As shown, the corners of the cover 110 do not have channels 115 but are smooth.

The surface features can be formed by any number of suitable techniques, including embossing, etc.

Figure 2:
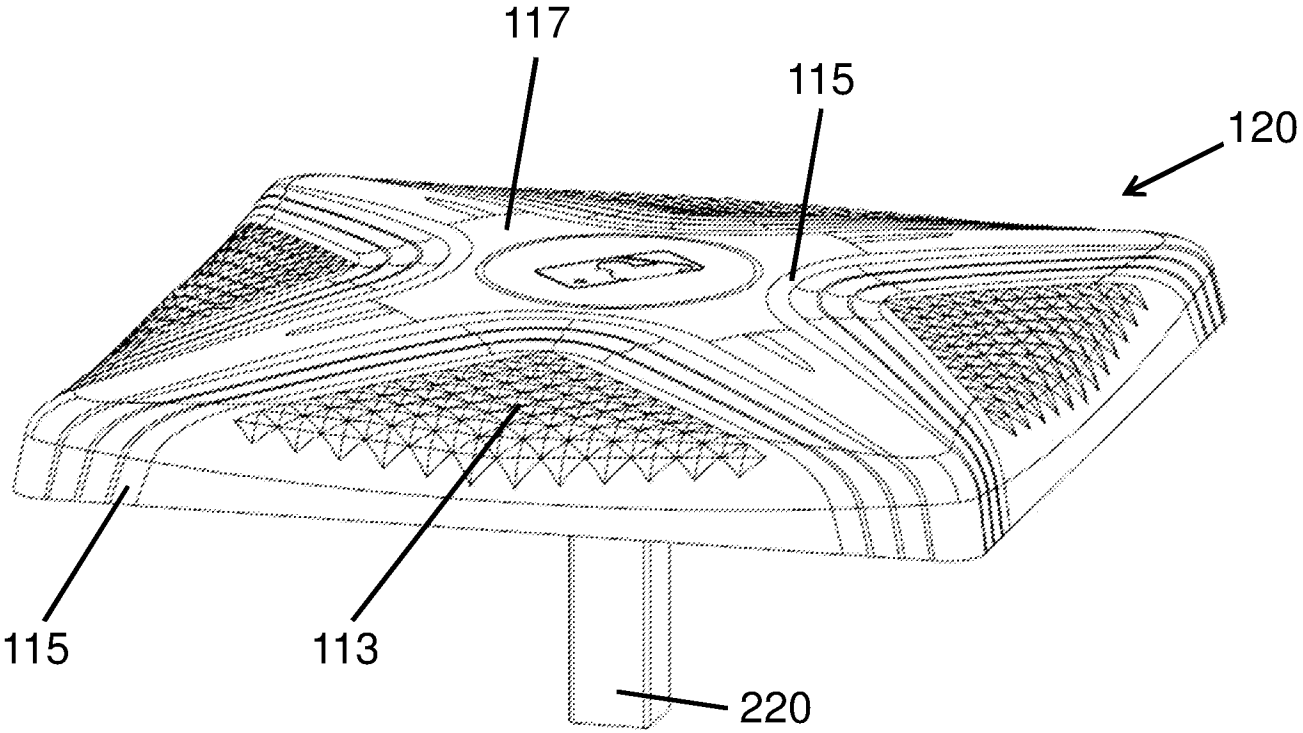
FIG. 2 is top and side perspective view of a baseball base according to a second implementation.

FIG. 2 illustrates a cover 120 according to another implementation. The cover 120 has the channels 115 and in this implementation, the channels 115 can be smooth, fading channels 115 that provide grip and wick water. The X-shaped region 117 is defined between and by the channels 115. The cover 120 can have other surface features including organic diamond patterns 113 with texture that provide grip and cushion. The cover 120 can also have a knurled texture that provides consistent grip. The center area of the cover 120 has a sufficient surface area to allow for a logo or other indicia to be included.

Figure 3:
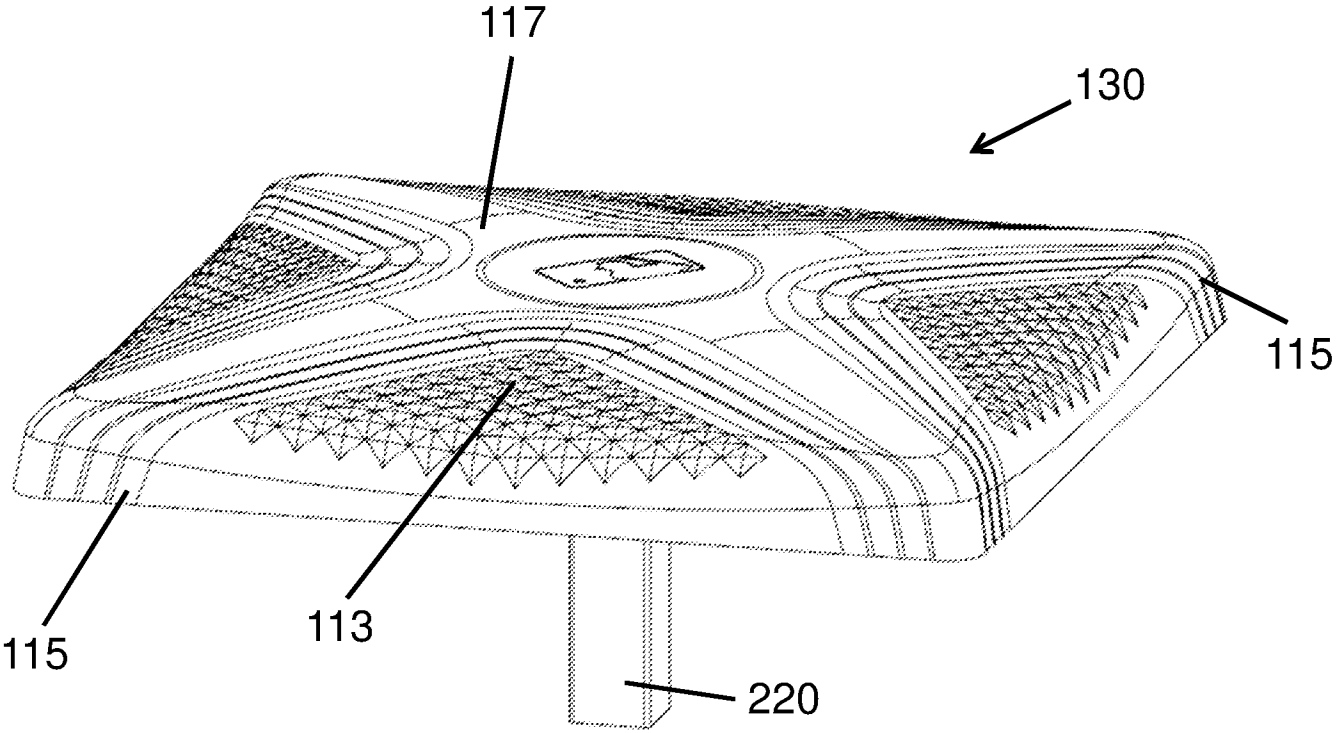
FIG. 3 is top and side perspective view of a baseball base according to a third implementation.
Figure 5:
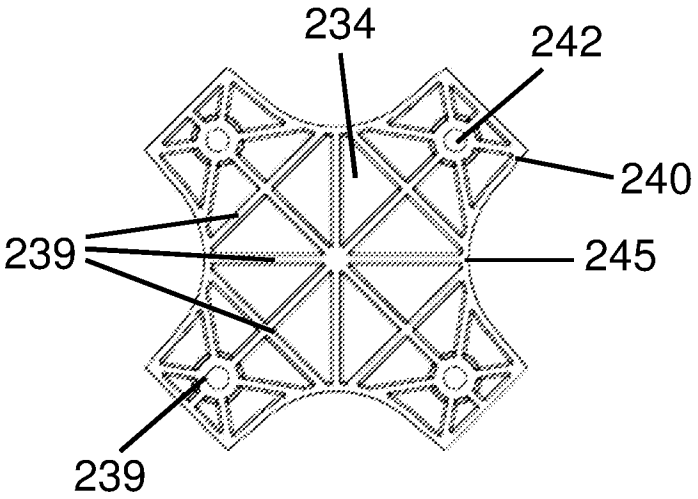
FIG. 5 is a top plan view of the ground anchor assembly.
Figure 4:
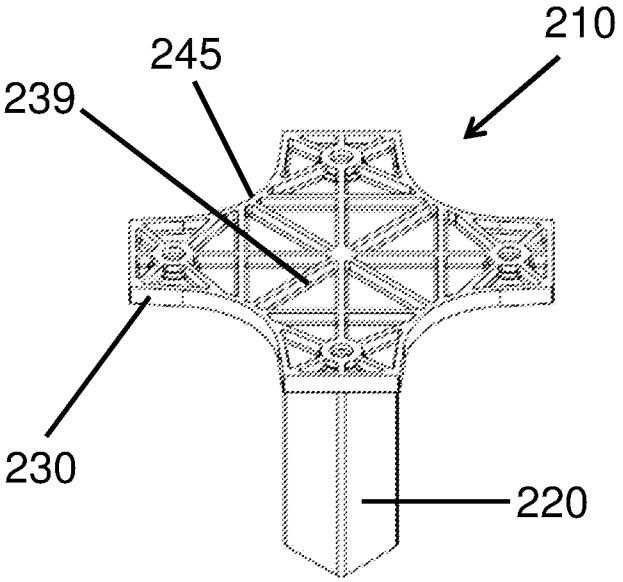
FIG. 4 is a top and side perspective view of a ground anchor assembly of the baseball base.
Figure 7:
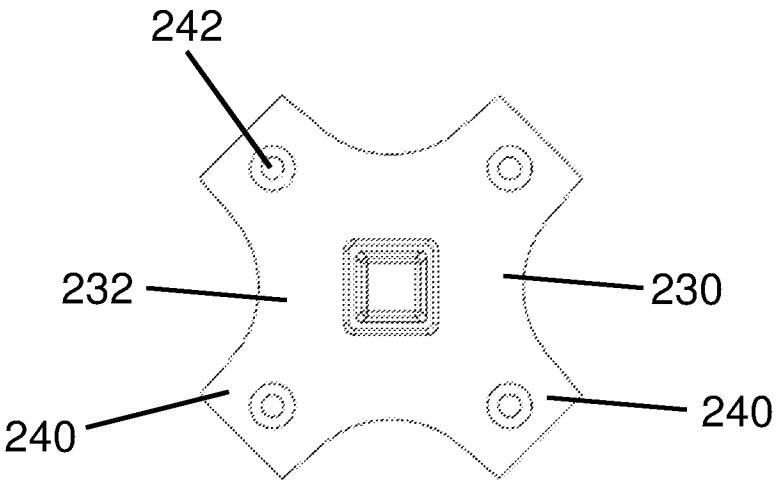
FIG. 7 is a bottom plan view of the ground anchor assembly.
Figure 6:
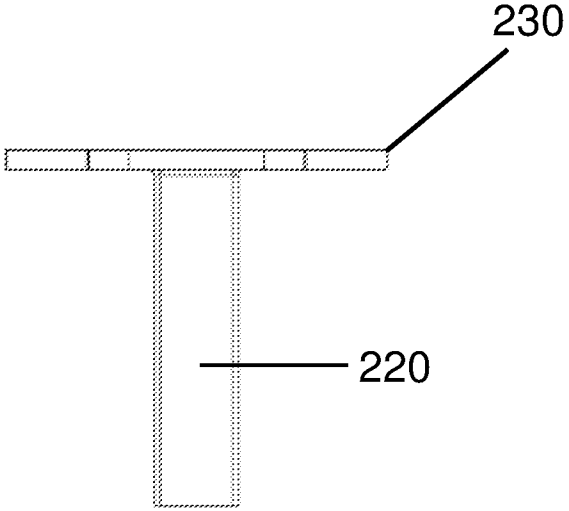
FIG. 6 is a side elevation view of the ground anchor assembly.
Figure 8:
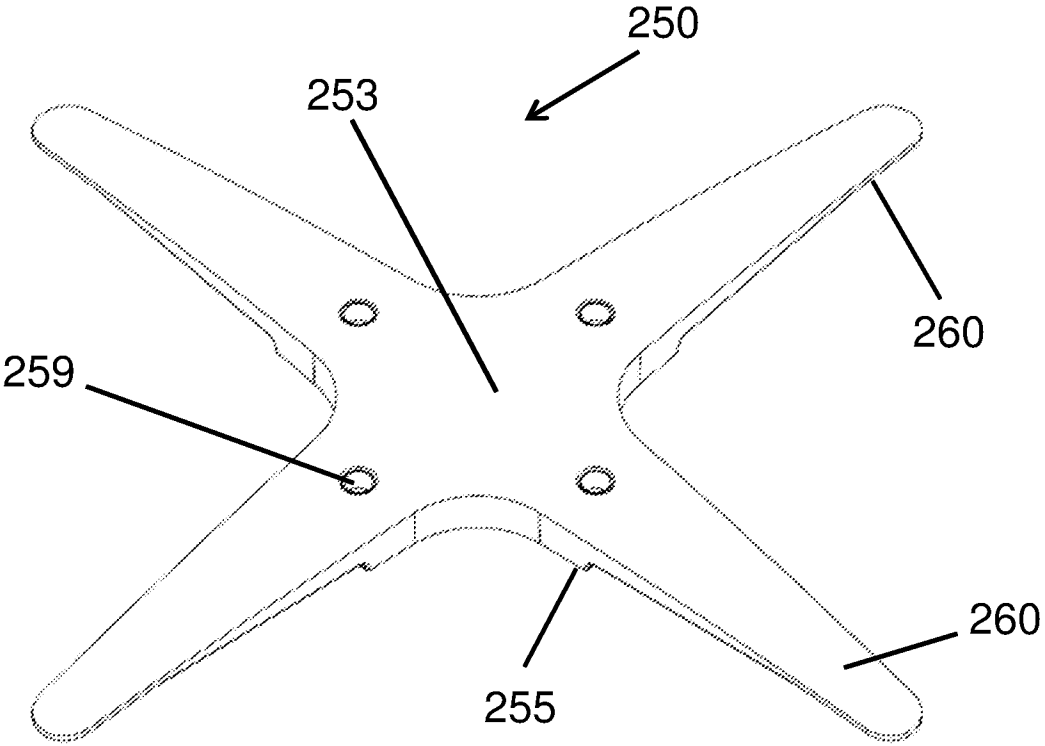
FIG. 8 is a top and side perspective view of an X-plate that is for coupling to the ground anchor assembly.
Figure 9:
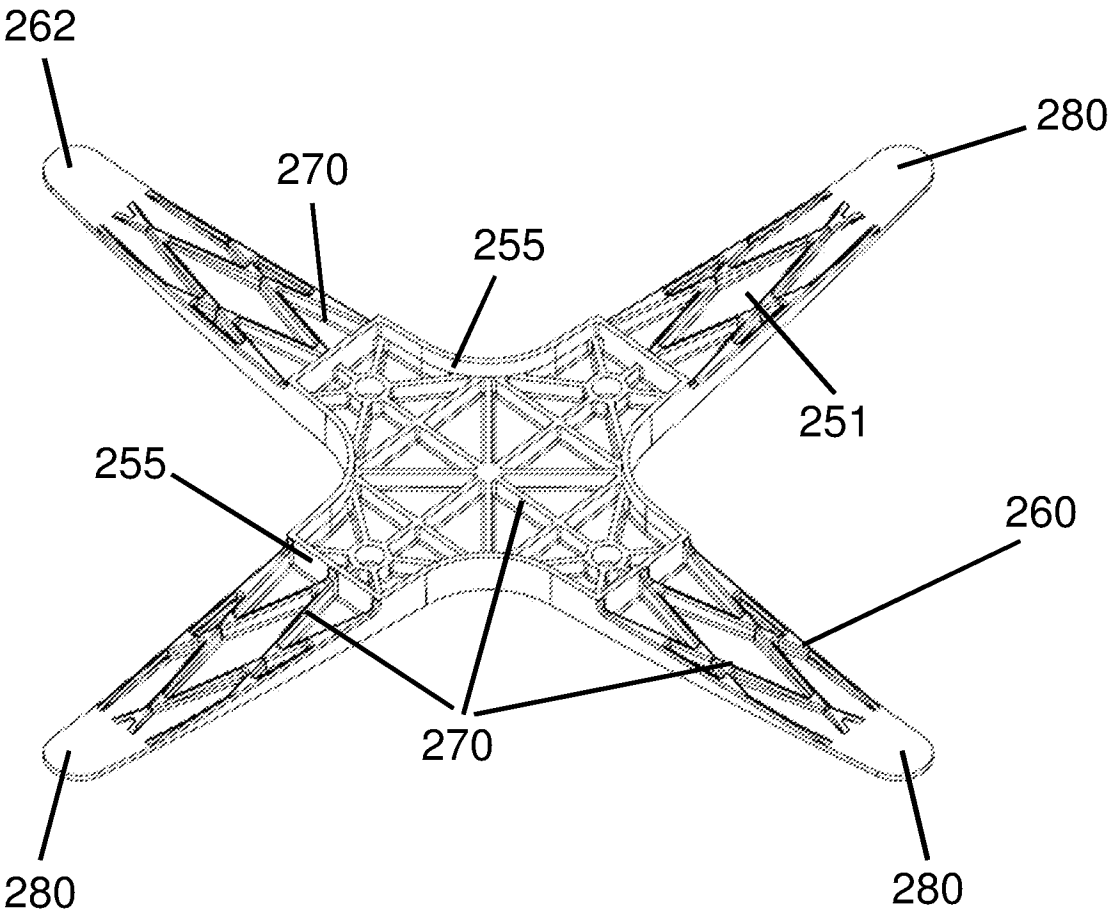
FIG. 9 is a bottom and side perspective view of the X-plate.
Figure 10:
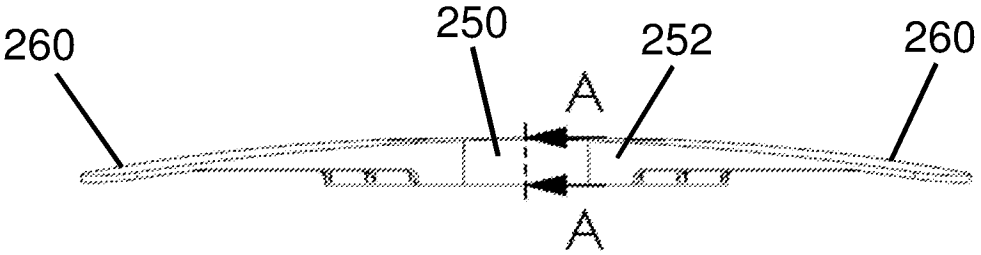
FIG. 10 is a side elevation view of the X-plate.

FIG. 3 illustrates a cover 130 according to another implementation that is similar to the cover 120 and therefore, like elements are numbered alike. The cover 130 includes a heavy texture that provides consistent grip. This texture can be applied all over the top surface of the cover 130 including the diamond patterns 113, the X-shaped region 117, etc.

It will be appreciated that any of the bases described herein that include the ground anchor assembly 200 can include any one of the covers 110, 120, 130 or have another cover. In other words, other covers not specifically illustrated herein can be used with the ground anchor assembly 200 that is illustrated and described herein.

Ground Anchor Assembly

Now referring to FIGS. 4-16, the ground anchor assembly 200 is formed of two parts, namely, a first part in the form of a ground anchor post 210 and an X-plate (reinforcement plate) 250 that is coupled to the ground anchor post 210. FIGS. 4-7 illustrate in more detail the ground anchor post 210 and FIGS. 8-13 illustrate the X-plate 250.

The ground anchor post 210 has a post 220 that is anchored into the ground playing surface as described herein and also a base portion (also referred to herein as being a ground anchor plate) 230 that is located along the top of the post 220. The base portion 230 is thus located above the post 220 and extends radially outward from the post 220 since the base portion 230 has a footprint that is greater than the footprint of the post 220.

The post 220 can be formed to have any number of different shapes including a square shape as shown. The length of the post 220 is selected to provide robust anchoring of the baseball base 100 into the ground playing surface.

The base portion 230 lies within a plane that is perpendicular to a vertical plane that extends through a center axis of the post 220.

The base portion 230 has a bottom surface 232 from which the post 220 extends outwardly from and an opposing top surface 234. The base portion 230 has a center portion 236 and a plurality of corner legs 240 that extend radially outward therefrom. The corner legs 240 are thus defined as two pairs with corner legs 240 of one pair being opposite one another and the corner legs 240 of the other pair being opposite one another. As shown, the interface between adjacent corners legs 240 is defined by a swept (curved) outer surface 245 as opposed to walls being formed at a right angle.

Within each corner leg 240 there is a single hole (through hole/opening) 242. This hole 242 receives a fastener for attaching the X-plate 250 to the ground anchor post 210 as described herein. Any number of different types of fasteners can be used including any number of bolts, screws, rivets, etc.

The post 220 is aligned with the center portion 236 and is aligned relative to corner legs 240 such that the corner leg 240 protrude outwardly from one corner of the square shaped post 220. The corners of the post 220 and the corner legs 240 are thus axially aligned.

The bottom surface 232 of the base portion 230 is the portion that makes contact with the ground playing surface and can have a smooth texture and appearance. In contrast, the top surface 234 is not smooth but is textured. More specifically and according to one implementation, the top surface 234 can include a plurality of interconnected (structural/reinforcing) ribs 239 and fillets that are formed thereon. Molded (e.g., injection molded) parts are often expected to hold up under a large load. One of the ways to strengthen a part, such as the base portion 230, is by adding one or more ribs 239 to the design. Ribs 239 are thin protrusions that extend perpendicular from a wall or plane (in this case a substrate of the base portion 230 with the ribs 239 extending upwardly therefrom) to provide added stiffness and strength. Designers commonly try to increase the strength of a part by making its walls thicker. Unfortunately, walls that are too thick are subject to warpage, sinking, and other defects. The advantage of using ribs, such as ribs 239, is that they increase the strength of a part without increasing the thickness of its walls. Because less material is required, ribs 239 can be a much more cost-effective solution as well. As is also known, in mechanical engineering, a fillet is a rounding of an interior or exterior corner of a part design.

As shown, the ribs 239 can be arranged in any number of patterns and each of the holes 242 has a circular shaped reinforcing rib formed thereabout (since the area around the hole 242 is an area of increased stress) and other ribs 239 extend inwardly from the peripheral edge of the base portion 230 and connect with other ribs 239 to form a network or matrix of ribs 239. The ribs 239 have common heights such that the top edges of ribs 239 lie in a single plane and define a flat surface on which the X-plate 250 is disposed.

The post 220 and base portion 230 can be a single integral structure and can be formed of any number of suitable materials that have the sufficient strength and rigidity for the intended application. In one implementation, the ground anchor post 210 is formed of a moldable material and the ground anchor port 210 is formed using conventional molding techniques and more particularly, the ground anchor post 210 can be formed of molded nylon with stainless steel hardware such as the fasteners that are used to attach the base portion 230 to the X-plate 250.

In one implementation, the base portion 230 has a thickness of about 3 mm and the ribs 239 have a thickness of about 6 mm. The post 220 can have a thickness of about 3 mm.

The X-plate 250 is configured to seat against and be coupled to the top surface 234 of the base portion 230. As shown in the figures (FIGS. 6 and 7), the X-plate 250 has a center portion 252 and a plurality of arms 260 that extend radially outward from the center portion 252. The X-plate 250 has a bottom surface 251 that seats against the top surface 234 of the base portion 230 and an opposite top surface 253.

The center portion 252 has a footprint that is complementary to the center portion 236 of the base portion 230 in that the center portion 252 is positioned above and seats against the center portion 236 of the base portion 230. The center portion 252 is thus of the same or similar shape and the same or similar dimensions of the center portion 236. Along the underside (bottom surface 251) of the X-plate 250 the center portion 252 can be defined by a raised border wall 255. The outline defined by the raised border wall 255 is thus the same or similar to the outline of the periphery of the base portion 230. The border wall 255 comprises integral wall segments that protrude outwardly from the bottom surface 251 (the border wall segments can be oriented perpendicular to the bottom surface 251). The raised border wall 255 can have a width of about 0.12 inches.

As shown, a distal end (distal tip) 262 of each arm 260 can be rounded.

Each arm 260 is an elongated structure and as illustrated, the arm 260 can have a tapered construction in that a width of the arm 260 varies in a direction from the center portion 252 to the distal end or tip 262 of the arm 260. More specifically, the width of the arm narrows in the direction from the center portion 252 to the distal end 262.

The top surface 253 of the X-plate 250 is preferably a smooth surface, while the opposing bottom surface 251 has a contoured, non-smooth construction. As shown in the figures, an underside (the bottom surface 251) of the X-plate 250 include a plurality or reinforcing ribs 270 and fillets similar to the top surface 234 of the base portion 230. Unlike the ribs 239 of the base portion 230, the ribs 270 along the underside of the X-plate 250 can have varying heights. In particular, the ribs 270 within the center portion 252 (within the border wall 255) can have a greater height as opposed to ribs 270 that are located within and along the arms 260. More particularly, the border wall 255 can have a greater height than ribs 270 within the other areas including those ribs 270 located along the arms 270.

Like the base portion 230, the X-plate 250 includes a plurality of through holes or openings 259 that are formed therein and are positioned such that when the base portion 230 of the ground anchor post 210 mates with the X-plate 250, the holes 242 of the corner legs 240 of the base portion 230 axially align with the holes 259 to allow fasteners to pass through the aligned holes 242, 259 for securely attaching the X-plate 250 to the base portion 230. The corner legs 240 of the base portion 230 overlap the proximal ends of the arms 260.

In one implementation, the openings 259 can be in the form of threaded inserts that have inner threads that mate with the outer threads of the fastener for securely attaching the two parts together. A circular shaped reinforcement rib 270 is formed about the opening 259 to increase strength thereat since the openings 259 represent areas of high stress.

As shown in the figures, a portion of the border wall 255 is located along the proximal ends of the arms 260.

The arms 260 include distal regions 280 that terminate in the distal ends 262 and the bottom surface 251 of each arm 260 within the distal region 280 can be free of ribs 270. In other words, this distal region 280 can be smooth along its bottom surface. The strategic positioning and formation of ribs 270 along the arms 260 is to control the degree of flexing of the arm 260 in view of the normal loads applied to the base, such as a player stepping on the corner of the base as the player rounds the bases, etc.

As with the center portion of the base portion 230 and the corner legs 240 that extend therefrom, the interface between the arms 260 is represented by a curved surface as opposed to a right angle.

Figure 11:
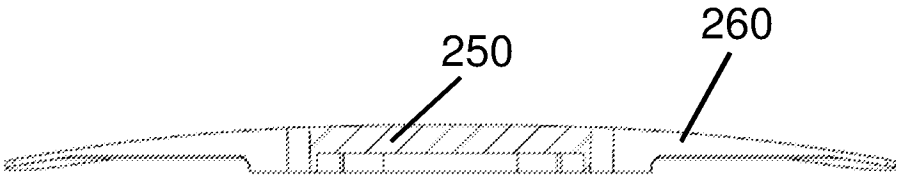
FIG. 11 is a cross-sectional view taken along the line A-A of FIG. 10.
Figure 12:
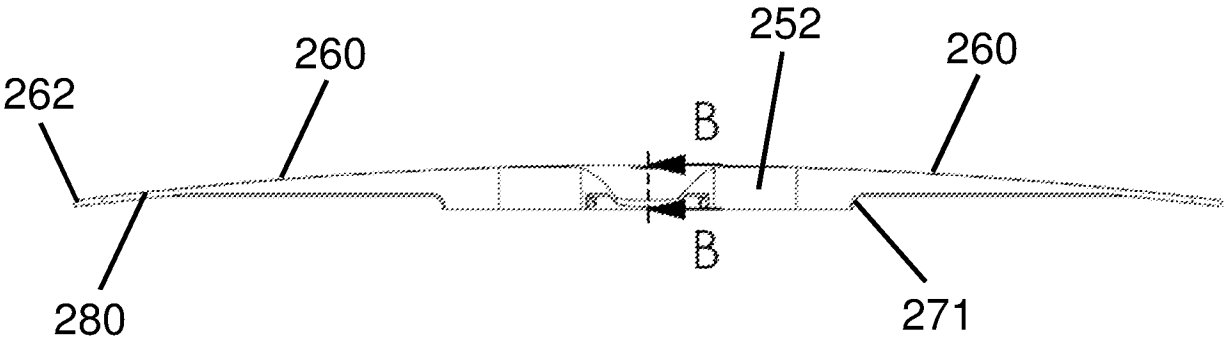
FIG. 12 is another side elevation view of the X-plate.
Figure 13:
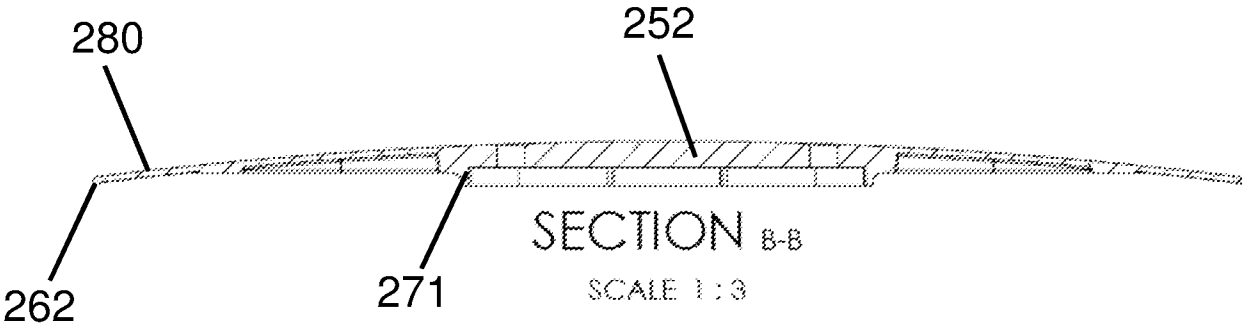
FIG. 13 is a cross-sectional view taken along the line B-B of FIG. 12.
Figure 14:
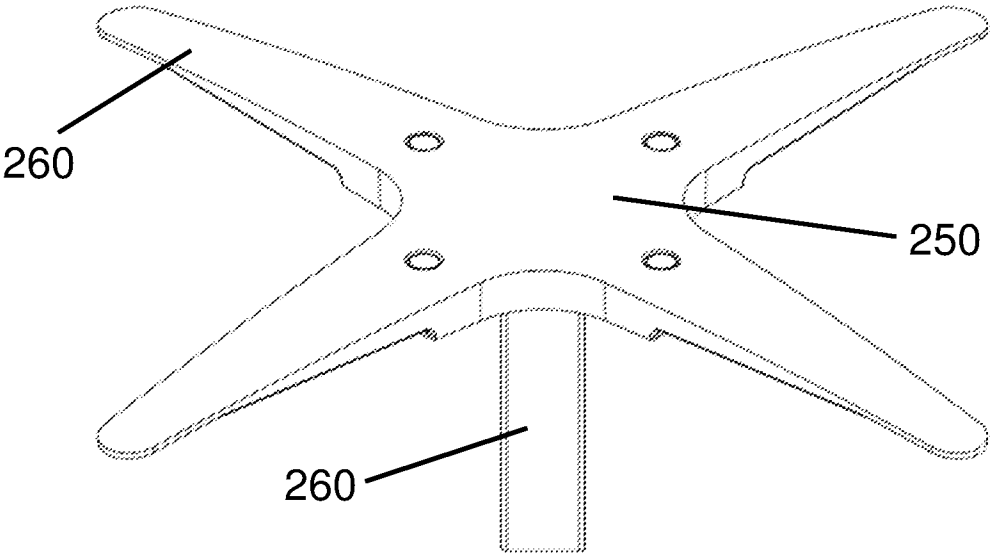
FIG. 14 is a top and side perspective view of the X-plate coupled to the ground anchor.
Figure 15:
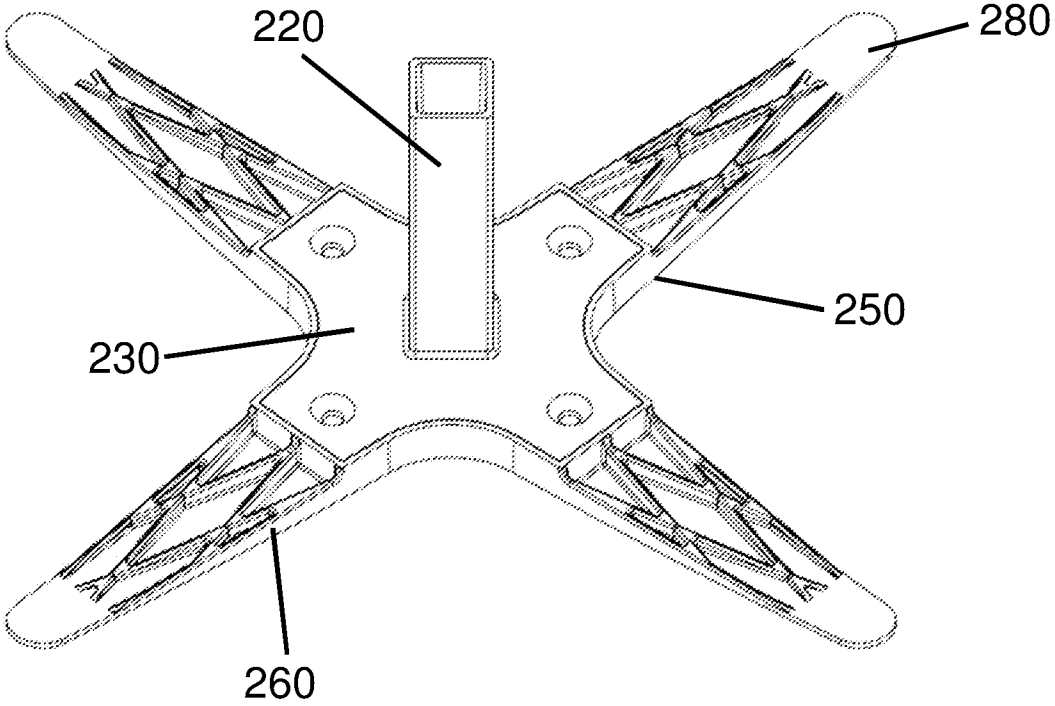
FIG. 15 is a bottom and side perspective view of the X-plate coupled to the ground anchor.

As shown in the cross-sectional view of FIGS. 11 and 13, the center portion 252 of the X-plate 250 can have a uniform thickness; however, the arms 260 can be formed to have a non-uniform thickness. As shown, the arm 260 has a stepped construction 271 and in particular, the border wall 255 can define the step 271 within the proximal region of the arm 260. As shown, the arm 260 can have a greater thickness in the proximate region as opposed to the distal region 280.

In one implementation, as shown in FIGS. 10-13, the arm 260 has a proximal region and an intermediate region in which the bottom surface lies in one plate and the distal region 280 can be a sloped or angled portion that extends downwardly from the flat intermediation region to the distal end (distal tip). The distal region 280 thus slopes downward.

In one implementation, the distance from the step 271 to the distal tip 262 is about 7.07 inches; the width of the proximal region of the arm 260 (adjacent the wall 255) is about 2.35 inches; and the width of the arm 260 in the distal region 280 is about 1.21 inches.

As shown, a substantial length of the arms 260 lies outside (radially outward) of the base portion 230.

It will therefore be appreciated that, as shown, the X-plate 250 takes an X-shape due to the fact that the arms 260 extend radially outward from the corners of the center portion 252 and since the center portion 252 and the base portion 230 have the same or similar footprint, the arms 260 extend radially outward from both.

The X-plate 250 can be formed of any number of different materials including but not limited to moldable materials. In one implementation, the X-plate 250 is formed of a molded nylon material.

Formation of the Cover

Figure 16:
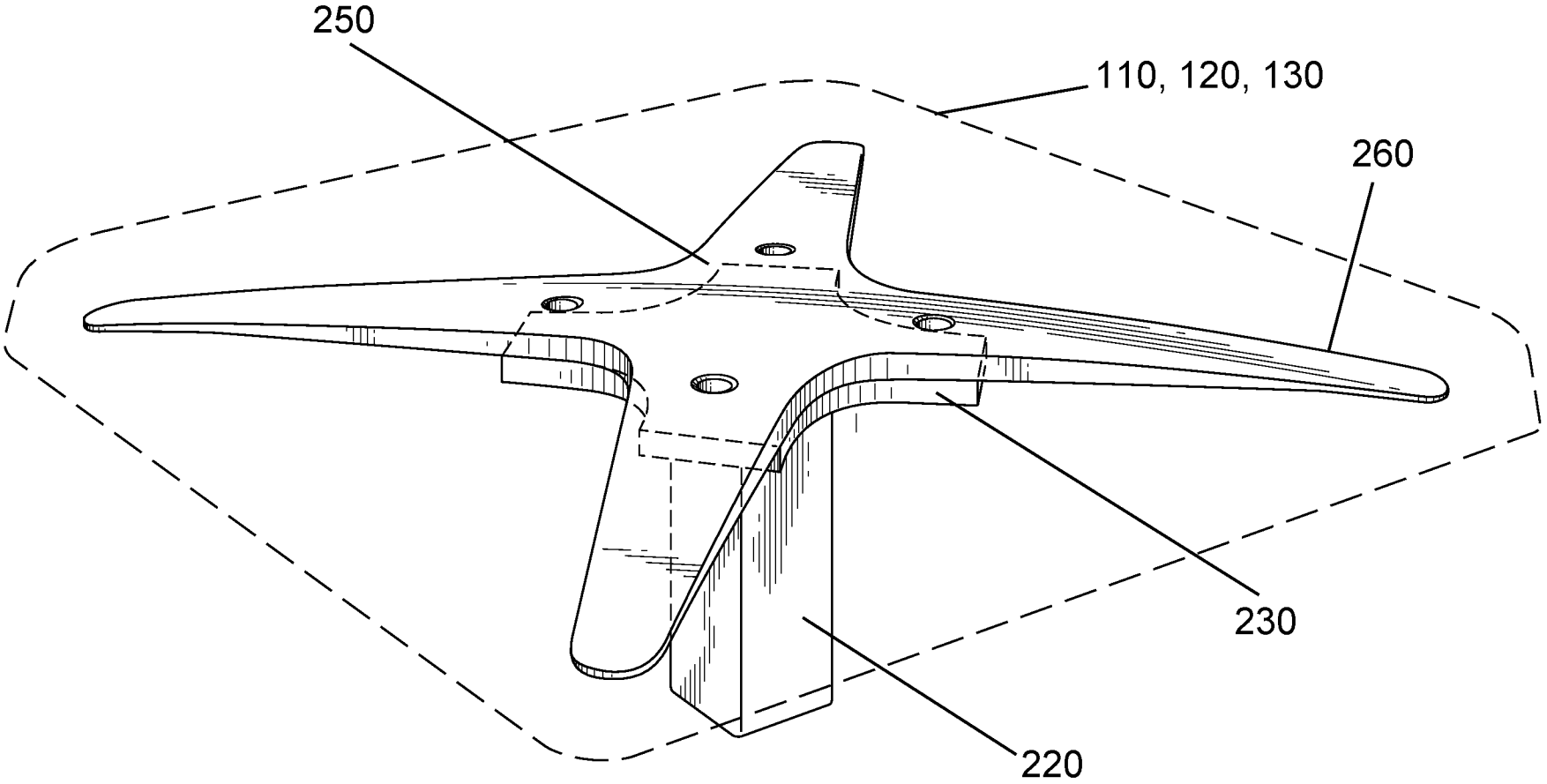
FIG. 16 is a perspective view of the cover with the X-plate being embedded therein, with the ground anchor assembly being omitted for ease of illustration.

As described herein, in one implementation, the cover 120 can be formed over the ground anchor assembly 200 using traditional techniques, such as an overmold process. For example, as described herein, the X-plate 250 can be inserted into and anchored within a mold part and then the mold parts are closed and the moldable material, such as a urethane, is injected to form the cover over the X-plate 250 such that the X-plate 250 is at least partially embedded within the material forming the cover. The surface features along the top surface of the cover 120 are formed during the overmold process. It will be appreciated that the four arms 260 are thus positioned and extend to the corners of the cover 120 (FIG. 16). In other words, the four arms 260 are located within the four corners of the base 100 leaving the areas immediately adjacent the four side walls of the base 100 to be free of reinforcement members, such as the X-plate 250 and ground anchor assembly.

Properties

As previously mentioned, there is a desire to provide a base that is constructed in view of player's movements along the field and in particular, the base 100 is constructed such that it has localized stiffness, while have reduced stiffness in other areas of the base 100. More particularly, along the sides of the base 100 that represent that areas of the base 100 that are typically contacted by the player, as when sliding into the base and/or rounding the bases, the base 100 is constructed to have reduced stiffness. In contrast, in its four corners, the base 100 has increased stiffness due to the presence of the arms 260 in the four corners. The middle of the base 100 has reinforcement due to the overlapping center sections of the X-plate 250 and base portion 230.

Testing of the parts of the base 100 show that the base 100 can withstand forces (loads) that are expected to be seen during normal play including both horizontally applied forces, vertically applied forces, torsional forces, etc. These forces (loads) result from a runner's foot contacting the base 100, such as sliding into the side of the base 100. The reinforcement ribs disclosed herein provide the desired stiffness of the base 100 and in particular, in the center portion and corners of the base 100. The base 100 has sufficient stiffness in the vertical direction, horizontal direction and the torsional direction.

The base 100 is constructed such that it has localized stiffness (areas of increased stiffness), while at the same time area of reduced stiffness that are strategically located along the base 100. More particularly, the areas of the base that have increased stiffness are the four corners, while the areas of the base that have reduced stiffness are the sides of the base 100 that are located between the corners of the base 100. It will be appreciated that when a runner slides into the side of the base, the runner's foot or hand will typically make contact with one side of the base defined between two arms 260 and thus, represents an area of reduced stiffness.

The illustrated base 100 is constructed to be in compliance with applicable rules from different authorities, including but not limited to Major League Baseball. With respect to Major League Baseball rules, the governing rule is:

> First, second and third bases shall be marked by white canvas or rubber-covered bags, securely attached to the ground . . . . The bags shall be 15 inches square, not less than three nor more than five inches thick, and filled with soft material.

The base 100 complies with such rule.

In addition, the base 100 has a large center sweet spot defined on the cover 110, 120, 130 that provides consistent grip and cushioning. The pronounced corners of the base 100 provide good push off toward the next base for runners and good feedback for fielders. The side of the base 100 between the arms 260 has a slightly ramped profile that makes the edges forgiving to incoming runners. Moreover, the corner surface grooves (channeling 115) provide finger grip on slides.

Installation

When installed, the post 220 of the base 100 is inserted into a hole or retaining sleeve located within the ground. The post 220 can travel vertically but not horizontally. An underside of the cover 110, 120, 130 will sit on the ground playing surface.

It will be understood that in terms of manufacturing, the cover 110, 120, 130 can be first formed over the X-plate 250 as by using an overmold process and then subsequently, the ground anchor assembly 200 is coupled to the X-plate 250 as by using fasteners described herein. For example, the mold can comprise two parts and along a floor of one mold, a raised protrusion in the form of the base plate 230 is provided and allows the X-plate 250 to be attached thereto to allow the cover 110, 120, 130 to be overmolded thereover. After the molding, the X-plate 250 can be detached from this raised mold structure and then later assembled with the ground anchor assembly 200. Similarly, the other mold part can include raised structures that form the surface features, such as channeling 115, in the cover when the mold parts are closed and the mold material is injected into the mold.

By forming the cover with the X-plate 250, shipping costs can be reduced since this combined structure can lay flat. At another location, the ground anchor assembly 200 can be attached to the X-plate 250. In addition, the ability to separate the X-plate 250 and the ground anchor assembly 200 allows the combined cover and X-plate 250 to be easily detached from the ground anchor assembly 200 for memorabilia purposes. In other words, after a game is completed, the used combined cover and X-plate 250 can be detached and sold and/or presented as fan memorabilia. This format (footprint) allows for easy mounting since a wall mount can have threaded fasteners that mate with the threaded inserts of the X-plate 250 to display the base 100.

EXAMPLE

In one implementation, each of the X-plate 250, ground anchor plate (base portion 230), and the ground anchor 220 is formed of a fiber reinforced polyamide (nylon) material that has high stiffness and dimensional stability.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A base for use in athletic base running games comprising:

a ground anchor assembly that includes: a post for insertion into a ground playing surface, and a ground anchor plate disposed along a top of the post;

an X-plate coupled to a top surface of the ground anchor plate, the X-plate having four arms arranged in an X orientation, the arms extending radially outward from the ground anchor plate; and a cover disposed over and coupled to the X-plate;

wherein the four arms of the X-plate are disposed in four corners of the cover.

2. A base for use in athletic base running games comprising:

a ground anchor assembly that includes: a post for insertion into a ground playing surface, and a ground anchor plate disposed along a top of the post;

an X-plate coupled to a top surface of the ground anchor plate, the X-plate having four arms arranged in an X orientation, the arms extending radially outward from the ground anchor plate; and a cover disposed over and coupled to the X-plate;

wherein the ground anchor plate has a center portion and four legs that extend outwardly from the center portion, each leg having a through hole that aligns with threaded inserts that are located in proximal regions of the arms for receiving fasteners to couple the X-plate to the ground anchor plate of the ground anchor assembly.

3. The base of claim 2, wherein the post is square shaped and corners of the posts are oriented relative to the four legs such that a first axis passes through two opposing corners of the post and two through holes formed in opposing legs and a second axis passes through the other two opposing corners of the post and two through holes formed in the other opposing legs.

4. The base of claim 1, wherein the top surface of the ground anchor plate includes a plurality of interconnected reinforcing ribs formed thereon.

5. The base of claim 3, wherein an outer peripheral edge between two adjacent legs comprises a curved edge.

6. The base of claim 4, wherein the ground anchor plate is defined by a substrate portion having a first thickness and the plurality of reinforcing ribs having a second thickness, the first thickness being less than the second thickness.

7. The base of claim 2, wherein the X-plate has a center portion with the four arms extending radially outward therefrom, the center portion of the X-plate overlying the center portion of the ground anchor plate with the legs of the ground anchor plate extending along proximal regions of the arms.

8. The base of claim 1, wherein the X-plate has a tapered construction in that a width of the X-plate narrows from a proximal region to a distal tip thereof.

9. The base of claim 1, wherein the X-plate has a non-uniform thickness in that the X-plate has a maximum thickness in a proximal region thereof and a minimum thickness at a distal end of the X-plate.

10. A base for use in athletic base running games comprising:

a ground anchor assembly that includes: a post for insertion into a ground playing surface, and a ground anchor plate disposed along a top of the post;

an X-plate coupled to a top surface of the ground anchor plate, the X-plate having four arms arranged in an X orientation, the arms extending radially outward from the ground anchor plate; and a cover disposed over and coupled to the X-plate;

wherein the X-plate includes reinforcement ribs formed along a bottom surface thereof including in a center portion and along the four arms.

11. The base of claim 10, wherein distal regions of the arms are free of ribs and have smooth undersides.

12. The base of claim 1, wherein each arm has a rounded distal end.

13. The base of claim 1, wherein the post has a square shape defined by four sides, each side of the post being oriented such that the side of the post lies between two adjacent arms.

14. The base of claim 1, wherein a top surface of the cover includes a plurality of embossed channels for wicking water.

15. The base of claim 14, wherein the embossed channels are arranged such that the channels are not in corners of the cover and an X-shaped region is formed that is free of the embossed channels.

16. A base for use in athletic base running games comprising:

a ground anchor assembly that includes a post for insertion into a ground playing surface;

a reinforcement plate that is coupled to the ground anchor assembly above the post and is configured to provide localized areas of increased stiffness, while also providing areas that lack reinforcement; and a cover disposed over and coupled to the reinforcement plate;

wherein the reinforcement plate comprises an X-plate, the X-plate having four arms arranged in an X orientation, the arms extending radially outward from the ground anchor assembly; and the cover is disposed over and coupled to the X-plate, wherein the X-plate has a plurality of reinforcing ribs formed along a bottom surface of the X-plate, with a distal tip region being free of the reinforcing ribs.

17. The base of claim 16, wherein the localized areas of increased stiffness are located in four corners of the base.

18. The base of claim 16, wherein the areas that lack reinforcement comprise sides of the base between adjacent corners of the base.

19. The base of claim 16, wherein the ground anchor assembly further includes a ground anchor plate disposed along a top of the post, the arms extending radially outward from the ground anchor plate.

20. The base of claim 19, wherein each arm has a tapered construction in that a width of the arm is greater within a proximal region of the arm than a distal tip region, the arm also having a non-uniform thickness with the proximal region having a thickness greater than a thickness in the distal tip region.

21. The base of claim 16, wherein the reinforcement plate has a plurality of threaded inserts that receive fasteners for attaching the reinforcement plate to a ground anchor plate of the ground anchor assembly.

* * * * *